US006520365B2

(12) United States Patent
Schneider

(10) Patent No.: US 6,520,365 B2
(45) Date of Patent: Feb. 18, 2003

(54) COLLAPSIBLE CONTAINER WITH DURABLE BOTTOM SHELL

(75) Inventor: Paul A. Schneider, Waunakee, WI (US)

(73) Assignee: Aquapore Moisture Systems, Phoenix, AZ (US)

( * ) Notice: Subject to any disclaimer, the term of this patent is extended or adjusted under 35 U.S.C. 154(b) by 0 days.

(21) Appl. No.: 09/909,302

(22) Filed: Jul. 19, 2001

(65) Prior Publication Data

US 2003/0015527 A1 Jan. 23, 2003

(51) Int. Cl.[7] ..... B65D 6/16

(52) U.S. Cl. ..... 220/9.2; 220/666; 220/904

(58) Field of Search ..... 220/666, 9.1, 9.2, 220/9.3, 9.4, 723, 720, 908, 908.1, 904, 475, 485, 646, 648, 669, 670, 673, 675, 743, 489, 490; 215/900, DIG. 6, 12.1, 376, 378, 382, 395

(56) References Cited

U.S. PATENT DOCUMENTS

| | | | | |
|---|---|---|---|---|
| 1,583,083 A | * | 5/1926 | Macaraig | 220/9.2 |
| 3,014,516 A | * | 12/1961 | Mueller | 138/131 |
| 5,251,460 A | | 10/1993 | DeMarco et al. | 62/371 |
| D347,577 S | | 6/1994 | Dire | D9/455 |
| D359,606 S | | 6/1995 | Holland | D34/1 |
| 5,564,568 A | | 10/1996 | Rankin, Sr. | 206/446 |
| 5,960,983 A | * | 10/1999 | Chan | 220/489 |
| 5,964,533 A | | 10/1999 | Ziglar | 383/36 |
| 6,089,394 A | | 7/2000 | Ziglar | 220/6 |
| D434,890 S | | 12/2000 | Cooper | D34/1 |

FOREIGN PATENT DOCUMENTS

| | | |
|---|---|---|
| WO | WO 98/03401 | 1/1998 |
| WO | WO 98/19917 | 5/1998 |

* cited by examiner

*Primary Examiner*—Stephen Castellano
(74) *Attorney, Agent, or Firm*—Foley & Lardner

(57) ABSTRACT

A collapsible container includes a cylindrical sidewall extending between a top and a bottom of the container. The sidewall is formed of a flexible material which enables the container to be opened to an expanded configuration or closed to a collapsed configuration. A coil spring biases the container to the open configuration. The coil spring has a top coil adjacent the top of the container and a bottom coil adjacent the bottom of the container. A durable bottom layer is affixed to the bottom of the container.

43 Claims, 4 Drawing Sheets

FIG. 3
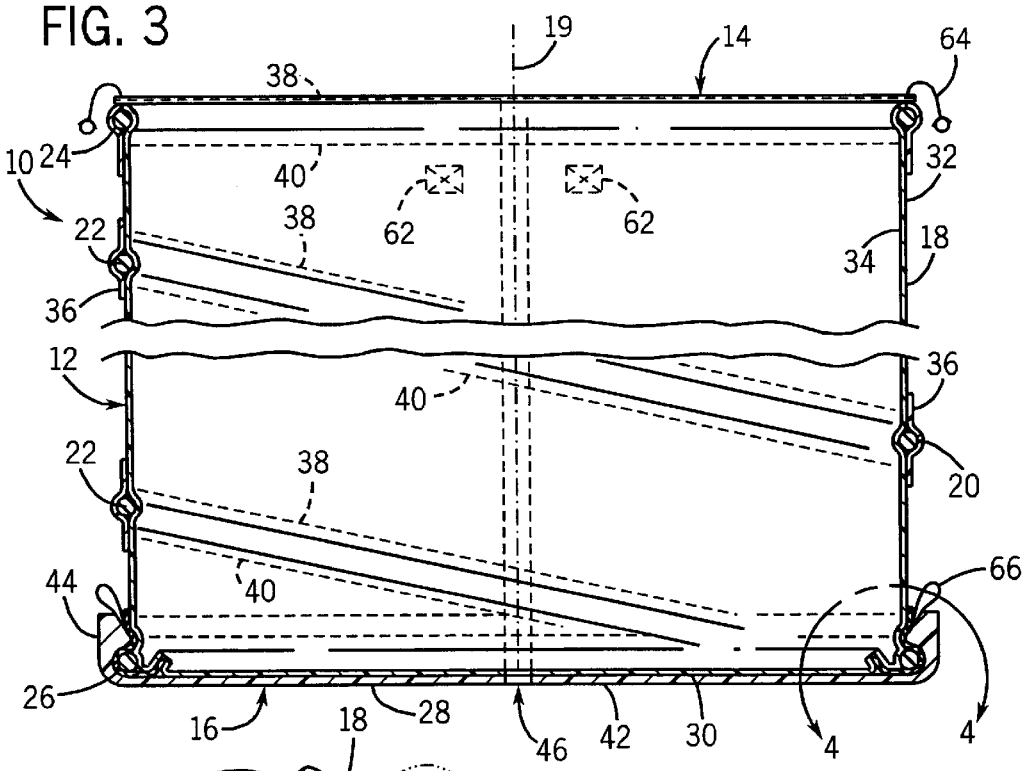
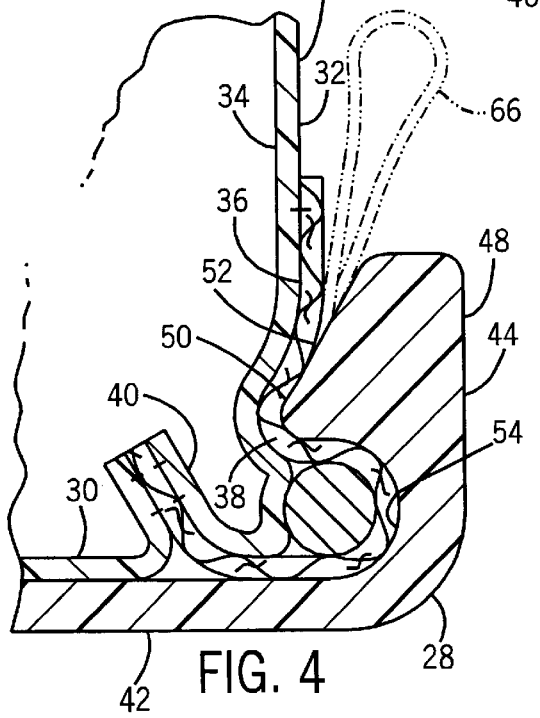
FIG. 4
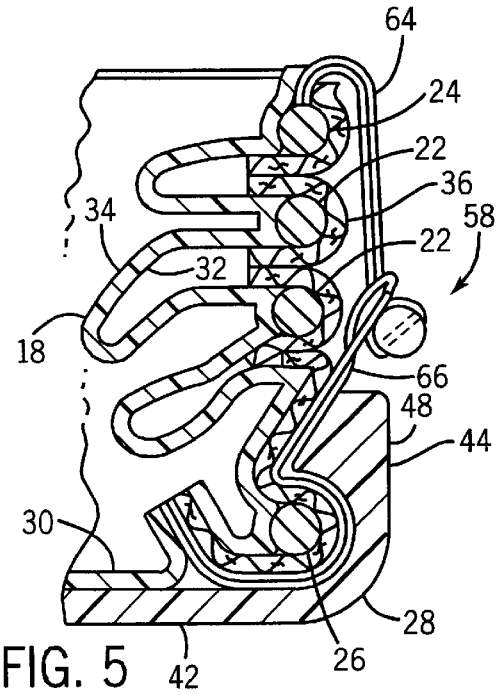
FIG. 5

FIG. 6
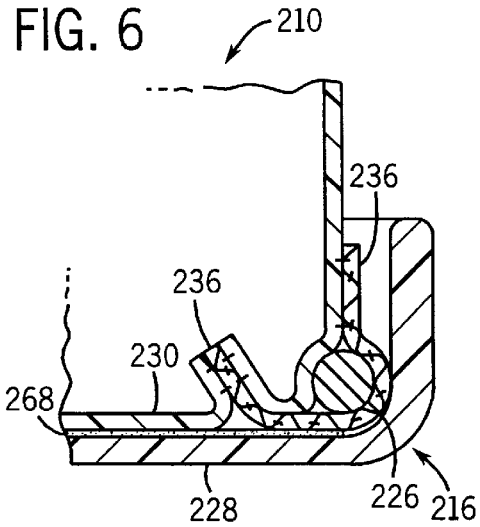
FIG. 7
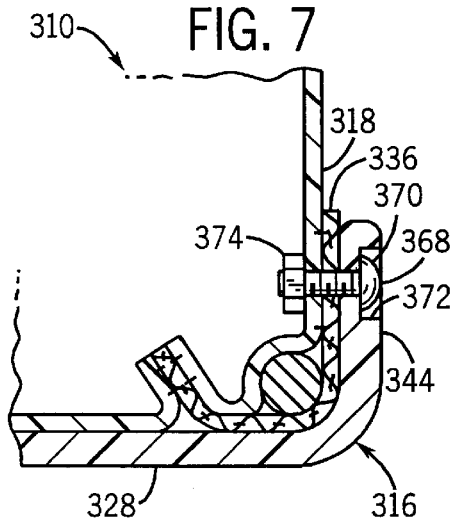
FIG. 8
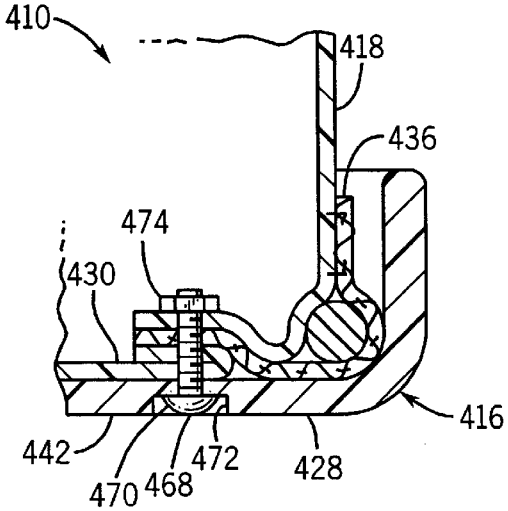
FIG. 9
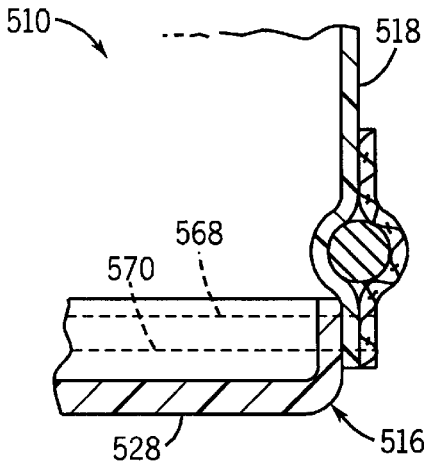
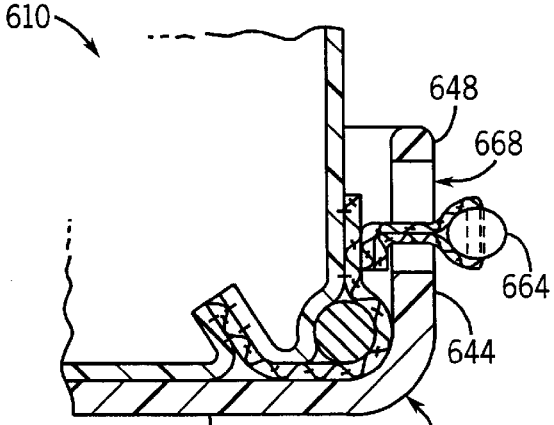
FIG. 10
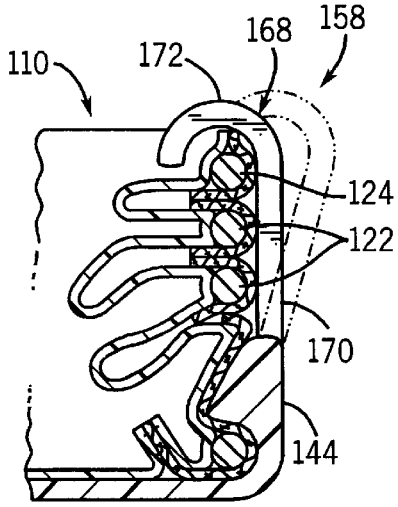
FIG. 11

COLLAPSIBLE CONTAINER WITH DURABLE BOTTOM SHELL

FIELD OF THE INVENTION

The present invention relates generally to containers that are expandable into open configurations for placing items therein and collapsible into compact configurations for facilitating storage when empty. More specifically, the invention relates to containers including flexible sidewalls provided with springs for biasing the containers to the expanded configuration.

BACKGROUND OF THE INVENTION

Collapsible containers designed for use around the house, the yard and at other locations are well known. For example, collapsible containers are often used for handling yard waste such as grass clippings, weeds, leaves and cut branches. Collapsible containers are also frequently used for temporary storage of items when traveling and for more permanent storage of items around the house or garage. Such collapsible containers offer a significant advantage over rigid containers that may also be used for these purposes in that the collapsible containers can provide a large volume of store space when expanded but require only a relatively small amount of space for storage of the container itself when empty and collapsed.

Collapsible containers including fabric sidewalls and bottom walls and coil springs for biasing the containers to their expanded configurations are well known. One drawback of these containers is that the lower edges of the fabric sidewalls and the fabric bottoms tend to wear out prematurely because these containers are loaded so heavily with items that they cannot be comfortably lifted and thus are dragged along the ground. The fabric can become torn if snagged or worn through from abrasion when dragged over rough surfaces such as concrete.

Although containers having sidewalls and bottom walls made from more durable materials (e.g., metals and relatively thick plastic layers) do not suffer from such premature wear, such containers are typically not collapsible and hence they require significant storage space when empty.

Consequently, it would be desirable to provide a collapsible container that is more durable than existing collapsible containers, while being relatively inexpensive to manufacture.

SUMMARY OF THE INVENTION

The present invention facilitates the durability of collapsible containers having flexible sidewalls and coil springs for biasing the containers to the expanded configuration by affixing durable bottom shells to such containers. The durable bottom shells provides such collapsible containers with increased durability when used for tasks as described above and other tasks in which the containers may be heavily loaded. Example of such other tasks include but are not limited to the use of such containers as a portable cooler or keg holder, as a laundry storage unit or hamper, as a portable tote bag, and the like.

According to a first aspect of the invention, a collapsible container includes a cylindrical sidewall extending between a top and a bottom of the container. The sidewall is formed of a flexible material which enables the container to be opened to an expanded configuration or closed to a collapsed configuration. A coil spring biases the container to the open configuration. The coil spring has a top coil adjacent the top of the container and a bottom coil adjacent the bottom of the container. A durable bottom layer is affixed to the bottom of the container.

According to another aspect of the invention, a collapsible container can be opened to an expanded configuration and closed to a collapsed configuration. A sidewall formed of a flexible material has an upper end adjacent a top of the container and a lower end adjacent a bottom of the container. A coil spring biases the container to the expanded configuration. The coil spring has a top coil adjacent the top of the container and a bottom coil adjacent the bottom of the container. A durable bottom layer is affixed to the bottom of the container.

According to a further aspect of the invention, a collapsible container has an expanded configuration and a collapsed configuration. The container includes a cylindrical sidewall formed of a flexible material. The sidewall has an upper end adjacent a top of the container and a lower end adjacent a bottom of the container. The sidewall is collapsible and expandable along an axis extending between the top and the bottom of the container. A durable plastic shell is secured to the bottom of the container.

These and other benefits and features of the invention will be apparent upon consideration of the following detailed description of preferred embodiments thereof, presented in connection with the following drawings in which like reference numerals identify like elements throughout.

BRIEF DESCRIPTION OF THE DRAWINGS

FIG. 3 is a cross-sectional view of the container of FIG. 1 taken along the line 3—3 in FIG. 1.

FIG. 4 is an enlarged cross-sectional view of the container of FIG. 3 taken along the line 4—4 in FIG. 3.

FIG. 5 is an enlarged cross-sectional view of the container of FIG. 2 taken along the line 5—5 in FIG. 2.

FIGS. 6–10 are cross-sectional views of bottom regions of alternative embodiments of containers in accordance with the present invention.

FIG. 11 is a cross-sectional view similar to FIG. 5 but showing an alternative arrangement for maintaining a spring loaded container in the closed configuration.

DETAILED DESCRIPTION OF THE PREFERRED EMBODIMENTS

Figure 1:
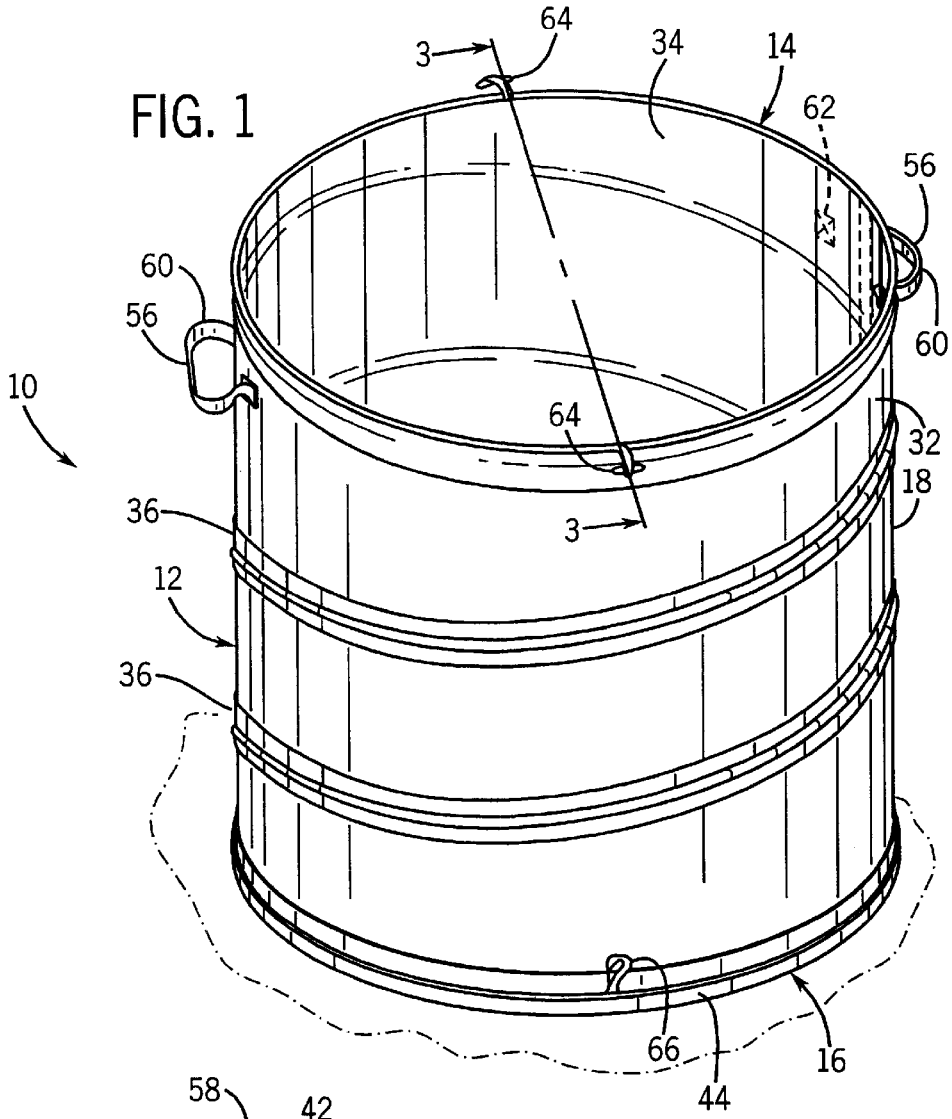
FIG. 1 is a perspective view of a preferred embodiment of a spring loaded container in accordance with the present invention, the container being shown in an open configuration.

Referring to FIGS. 1–5 , a container 10 is shown in accordance with a first embodiment of the present invention. Container 10 includes a cylindrical sidewall 12 extending between a top 14 and a bottom 16 of container 10. Sidewall 12 is formed of a flexible material 18 so that container 10 can be repeatedly opened and closed between an expanded configuration (see FIGS. 1 and 3) and a collapsed configuration (see FIGS. 2 and 4) along an axis 19 (see FIG. 3) without causing any appreciable wear or damage to container 10. Sidewall 12 includes a coil spring 20 that biases container 10 to the expanded configuration. Coil spring 20 includes a central spiral portion 22 that extends between a top coil portion 24 adjacent container top 14 and a bottom coil portion 26 adjacent container bottom 16. Coil spring 20 may be made of any suitable material such as plastic or metal, but preferably is hardened spring steel. A durable hard shell 28 (described in detail below) is secured to container bottom 16. In addition, a flexible inner layer 30 may be secured to container bottom 16 immediately above (and thus protected by) durable shell 28.

By way of example, flexible sidewall material 18 and flexible inner layer 30 may be fabricated from fabric. The term "fabric" as used herein means any material that is woven, knit, braided, or netted with any fiber, as well as non-fibrous PVC, urethane, nylon or other synthetic materials. The fabric may be porous or non-porous. The fabric can be formed from various fibers including organic fibers such as cotton, animal fibers such as wool, or synthetic or man-made fibers such as cellulose. The fabric may be one fiber or a combination of these fibers, or without fibers altogether. The primary characteristic is that the fabric material be flexible enough to permit repeated closings and openings of container 10 without causing appreciable damage to the material. One particular example of a suitable fabric is vinyl coated scrim, which is known to those skilled in the art TARPAULINE.

As best seen in FIGS. 1 and 3, coil spring 20 is secured to sidewall 12 with spiral portion 22 extending along an outer surface 32 of flexible sidewall material 18. Alternatively, spiral portion 22 could be positioned to extend along an inner surface 34 of sidewall material 18. In the illustrated embodiment, spiral portion 22 is secured to sidewall material 18 by means of a thin strip of material 36 affixed to flexible sidewall material 18 with spiral portion 22 captured therebetween. As illustrated, strip material 36 is secured to sidewall material 18 by a first line of stitches 38 extending parallel to (and just above) spiral portion 22 and a second line of stitches 40 extending parallel to (and just below) spiral portion 22. Persons skilled in the art will recognize that other techniques could be used for securing strip material 36 to flexible sidewall material 18, such as adhesives, welding and the like. In addition, strip material 36 may be eliminated if coil spring 20 is directly secured to flexible sidewall material 18. For example, a plurality of loops—made of fabric, plastic, metal or some other suitable material—could be positioned at spaced locations along the length of spiral portion 22 to join sections of sidewall material 18 to spiral portion 22.

Again by way of example and not limitation, strip material 36 may be a natural occurring or synthetic fibers or a mixture of fibers as indicated above. In a preferred embodiment, strip material 36 comprises a woven fabric such as polyester or nylon.

Durable bottom shell 28 is configured to extend over and protect container bottom 16. As illustrated, bottom shell 28 generally includes a plate-like central portion 42 and an upturned outer edge 44 extending around the outer perimeter of central portion 42. Central portion 42 may include one or more drainage holes 46 (see FIGS. 2 and 3) to prevent liquid (e.g., water) from pooling in bottom shell 28. As best illustrated in FIG. 4, upturned edge 44 includes an outwardly facing surface 48 and an inwardly facing surface 50. Inwardly facing surface 50 includes an upwardly and inwardly facing ramp 52 situated above an inwardly opening annular cavity or channel 54. Annular channel 54 is dimensioned to closely receive bottom coil 26 when covered by strip material 36. Ramp 52 facilitates assembly of container 10 by providing a sloped surface (e.g., 30° from the vertical axis) configured to guide bottom coil 26 into annular channel 54. Ramp 52 may be formed as a plurality of upwardly and inwardly facing surfaces (e.g., two or four) situated about inner surface 50 of upturned edge 44 or as a single upwardly and inwardly facing surface that extends continuously around inner surface 50 except for a brief gap (not shown) which accommodates coil spring 20 as it extends upwardly from bottom coil 26 to central spiral 22.

By way of example, bottom shell 28 may comprise a durable organic material (e.g., leather), a durable plastic material (e.g., polystyrene or polypropylene) or a lightweight metal (e.g., aluminum). Plastic materials such as polystyrene and polypropylene are well suited for the present invention because of their generally good durability and relatively low cost. In addition, such plastic materials are easily molded (e.g., by injection molding or vacuum forming) into the desired shape.

With the foregoing structure, bottom shell 28 can be affixed to container 10 by simply snap-fitting it over bottom coil 26 so that bottom coil 26 interlocks with annular channel 54 (see FIGS. 3 and 4). Persons skilled in the art will of course recognize that many other techniques could be used for attaching bottom shell 28 to container 10, a few examples of which are described and illustrated below.

Figure 2:
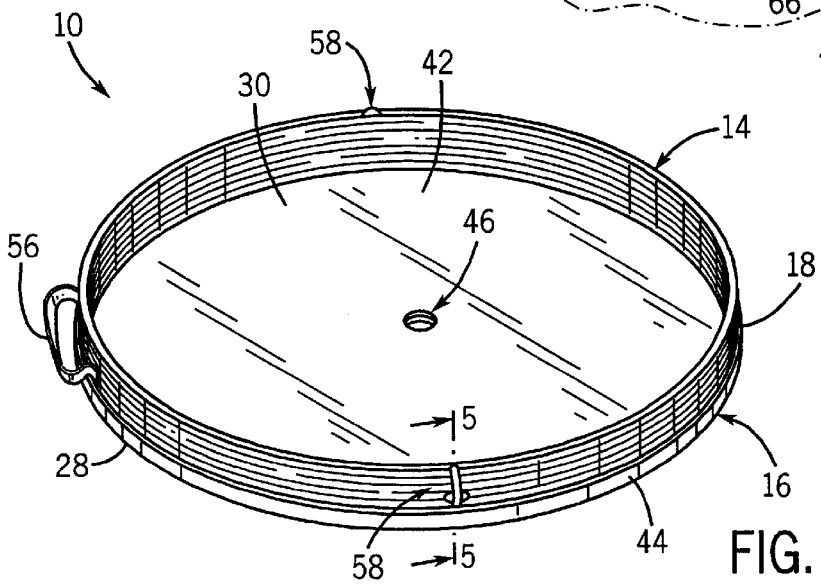
FIG. 2 is perspective view of the container of FIG. 1, the container being shown in a closed configuration.

In the illustrated embodiment, container 10 also includes a pair of handles 56 (see FIG. 1) and a tie down structure 58 (see FIGS. 2 and 5). Handles 56 facilitate the lifting and moving of container 10, while tie down structure 58 is used to maintain container 10 in the collapsed configuration. Handles 56 may comprise a strip of material 60 affixed to flexible sidewall material 18 by stitching 62 (see FIG. 3). Tie down structure 58 may comprise a pair of T-straps 64 secured to container top 14 and a pair of mating flexible loops 66 secured to container bottom 16 (see FIG. 1).

With the foregoing structure, container 10 can be easily locked into the collapsed configuration by first compressing coil spring 20 and then inserting the distal end of each T-strap 64 through its mating loop 66. Once this is done, each T-strap 64 will interlock with its mating loop 66, which thus prevents central spiral portion 22 of spring 20 from expanding. Hence, container 10 will remain in the collapsed configuration. Container 10 can be opened to its expanded configuration by again compressing coil spring 20 and then withdrawing each T-strap 64 from engagement with its mating loop 66.

Referring now to FIG. 11, a container 110 in accordance with a second embodiment of the present invention is shown. Container 110 is substantially identical to container 10 (FIGS. 1–5) described above except for the different tie down structure. For brevity, elements of container 110 that correspond to like elements in container 10 described above will be identified by the same reference numerals but increased by 100.

In FIG. 11, container 110 includes a tie down structure 158 that extends upwardly from upturned edge 144. Tie down structure 158 comprises a flexible hook 168 having an upwardly extending base portion 170 and an inwardly extending curved end portion 172. Flexible hook 168 may be integrally formed with upturned edge 144 or separately manufactured therefrom and then secured thereto during subsequent assembly.

With the foregoing structure, container 110 can be easily locked into the collapsed configuration by first compressing coil spring 120 and then moving curved end 172 of flexible hook 168 radially inwardly until it is directly above top coil 124 of spring 120. Once this is done, hook 168 will prevent spiral portion 122 of spring 120 from expanding and thus container 110 will be maintained in the collapsed configuration. Container 110 can be opened to its expanded configuration by again compressing coil spring 120 and then moving curved end 172 of hook 168 radially outwardly until it is no longer above top coil 124 of spring 120. Persons skilled in the art will recognize that other structures and methods could be used for releasably locking the collapsible containers in their compact configurations.

Referring now to FIGS. 6–10, a number of containers 210–610 in accordance with alternative embodiments of the present invention are shown. Containers 210–610 are substantially identical to container 10 (FIGS. 1–5 ) described above except for the different durable bottom shells and their associated attachment means. For brevity, elements of containers 210–610 that are similar to like elements in container 10 described above will be identified by the same reference numerals but increased by 200, 300, 400, 500 and 600, respectively.

In FIG. 6, container 210 includes a durable bottom shell 228 affixed to container bottom 216 by an adhesive layer 268. Adhesive layer 268 extends over the entire downwardly facing surface of flexible inner bottom layer 230 as well as the downwardly facing surface of strip material 236 covering bottom coil 226.

In FIG. 7, container 310 includes a durable bottom shell 328 affixed to container bottom 316 by a plurality of horizontally extending bolts 368. Each bolt 368 extends horizontally through upturned edge 344 of bottom shell 328, strip material 336 and sidewall material 318. Each bolt 368 has a head 370 countersunk into an aperture 372 formed in upturned edge 344 and is secured in place by a nut 374.

In FIG. 8, container 410 includes a durable bottom shell 428 affixed to container bottom 416 by a plurality of vertically extending bolts 468. Each bolt 468 extends vertically through central portion 442 of bottom shell 428, flexible inner bottom layer 430, strip material 436 and the lower edge of sidewall material 418. Each bolt 468 has a head 470 countersunk into an aperture 472 formed in central portion 442 and is secured in place by a nut 474

In FIG. 9, container 510 includes a durable bottom shell 528 affixed to container bottom 516 by a pair of stitch lines 568. Bottom shell 528 is sewn to the lower edge of flexible sidewall material 518 instead of a flexible inner bottom layer (which is omitted in this embodiment). To facilitate the ease of such stitching, bottom shell 528 of container 510 may be thinner than bottom shell 28 of container 10 (FIGS. 1–5 ). For example, bottom shell 528 may have a thickness of between about 0.01 to 0.02 inches. By contrast, bottom shell 28 may have a thickness of between about 0.05 to 0.20 inches. Of course, the particular thickness of the durable bottom shell is unimportant so long as it is able to sufficiently protect the bottom of the container and prevent premature wear as discussed above.

In FIG. 10, container 610 includes a durable bottom shell 628 affixed to container bottom 616 by a plurality (e.g., two or four) of T-straps 664 and mating apertures 668 formed in upturned edge 644. As illustrated, each aperture 668 is elongated in the vertical direction so that each T-strap 664 can be inserted through its associated aperture 668 and then rotated 90° to interlock with outer surface 648 of upturned edge 644. Container 610 also includes a plurality of fabric loops (not shown) secured to the top of the container for matingly engaging with T-straps 664 to lock container 610 in the collapsed configuration. Thus, T-straps 664 in container 610 serve the dual purpose of securing bottom shell 628 to container bottom 616 and maintaining container 610 in the collapsed configuration.

Figure 12:
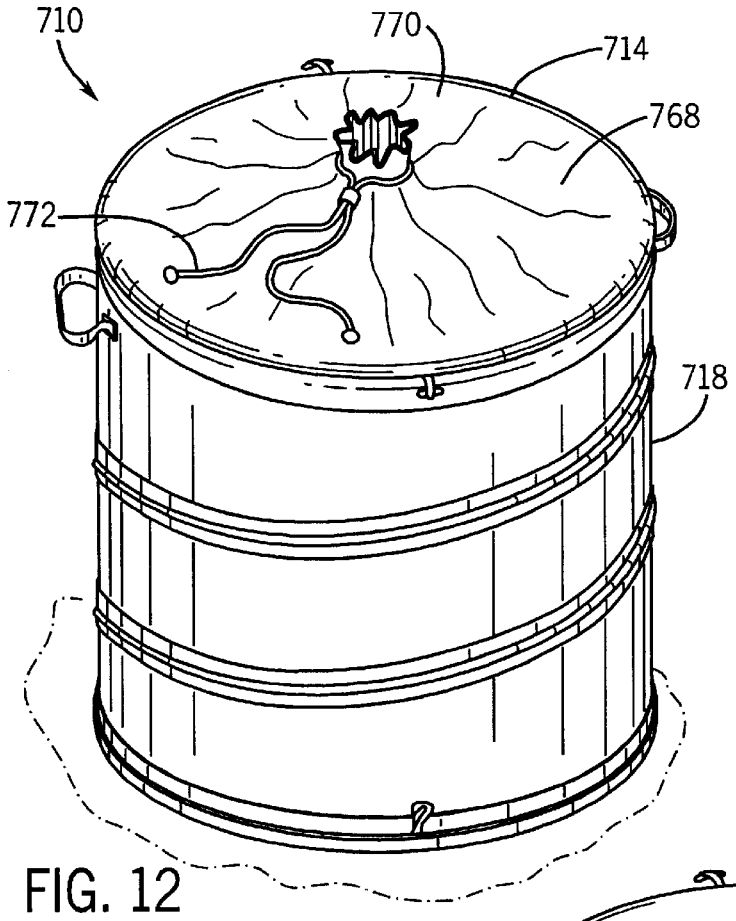
FIGS. 12–13 are perspective views of additional embodiments of spring loaded containers in accordance with the present invention, the containers being shown in the open configuration.
Figure 13:
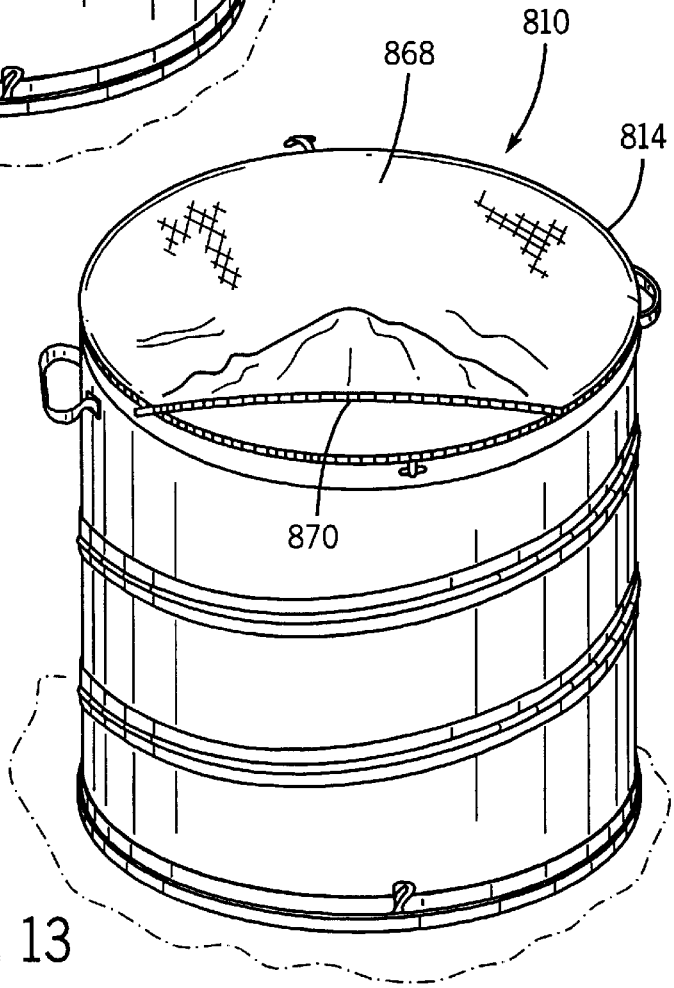

Referring now to FIGS. 12–13, a pair of containers 710 and 810 in accordance with additional alternative embodiments of the present invention are shown. Containers 710 and 810 are substantially identical to container 10 (FIGS. 1–5) described above except for the different container top. For brevity, elements of containers 710 and 810 that are similar to like elements in container 10 described above will be identified by the same reference numerals but increased by 700 and 800, respectively.

In FIG. 12, container 710 includes a cover 768 affixed to container top 714. As illustrated, cover 768 comprises an annular sheet of fabric 770 and a centrally located drawstring 772. Fabric 770 may be integrally formed with flexible sidewall material 718 or it may be separately formed and then secured (e.g., by stitching) to sidewall material 718 during a subsequent assembly step.

In FIG. 13, container 810 includes a removable cover 868 affixed to container top 814 by a zipper 870. Removable cover 868 could be releasibly secured to container top by numerous other means known to those skilled in the art, such as VELCRO® (i.e. hook-and-loop fasteners).

It is important to note that the above-described preferred embodiments of the spring loaded containers are illustrative only. Although only certain embodiments have been described above in detail, those skilled in the art will appreciate that numerous modifications are possible without materially departing from the novel teachings and advantages of the subject matter described herein. For example, although all the containers described above are cylindrical in shape and thus have circular cross-sections when viewed along a horizontal plane, they could have differently shaped cross-sections such as square, triangular, octagonal or any other desired shape. Accordingly, these and all other such modifications are intended to be included within the scope of the present invention. Other substitutions, modifications, changes and omissions may be made in the design, operating conditions and arrangement of the preferred and other exemplary embodiments without departing from the spirit of the present invention.

What is claimed is:

1. A collapsible container, comprising:

a cylindrical sidewall formed of a flexible material, the sidewall having an upper end adjacent a top of the container and a lower end adjacent a bottom of the container;

a coil spring biasing the container to an expanded configuration, the coil spring having a top coil adjacent the top of the container and a bottom coil adjacent the bottom of the container;

a durable bottom shell affixed to the bottom of the container, the bottom shell including a plate-like central portion having an outer periphery underlying the bottom coil, and a substantially rigid horizontally extending member coupled to the bottom shell and overlying an apex of the bottom coil to vertically capture and clamp the bottom coil between the outer periphery of the bottom shell and the horizontally extending member.

2. The container of claim 1, wherein the flexible sidewall material is a fabric.

3. The container of claim 2, wherein the fabric is porous.

4. The apparatus of claim 2, wherein the fabric is nonporous.

5. The container of claim 4, wherein the fabric is coated or impregnated with a plastic.

6. The container of claim 2, wherein the fabric is vinyl coated scrim.

7. The container of claim 1, wherein the coil spring extends around an outer surface of the flexible sidewall material.

8. The container of claim 7, wherein the coil spring is secured to the outer surface of the flexible sidewall material by one or more strips of material sewn to the flexible sidewall material with the spring positioned between the flexible sidewall material and the one or more strips.

9. The container of claim 8, wherein the strips of material are a woven fabric.

10. The container of claim 1, wherein the durable bottom shell is a plastic layer which is relatively inflexible compared to the flexible sidewall material.

11. The container of claim 10, wherein the durable bottom shell is polystyrene or polypropylene.

12. The container of claim 10, wherein the durable bottom shell is a vacuum formed or injection molded plastic layer.

13. The container of claim 1, wherein the durable bottom shell covers the entire bottom of the container and a portion of the flexible sidewall material adjacent the bottom coil.

14. The container of claim 1, wherein the durable bottom shell includes one or more drainage holes.

15. The container of claim 1, further including an inner bottom fabric layer protected by the durable bottom shell.

16. The container of claim 1, further including means for maintaining the container in the collapsed configuration.

17. The container of claim 16, wherein the maintaining means comprises fabric loops and T-straps, or a hook.

18. The container of claim 1, wherein the coil spring is made of hardened spring steel.

19. The container of claim 1, wherein the durable bottom shell has a thickness of between about 0.05 to 0.20 inches and the flexible sidewall material has a thickness of between about 0.01 to 0.02 inches.

20. The container of claim 1, wherein the bottom shell includes an upturned edge coupled to the outer periphery, and the horizontally extending member extends radially inwardly from the upturned edge at one or more locations.

21. The container of claim 20, wherein the horizontally extending member is integral with the upturned edge.

22. The container of claim 1, wherein the horizontally extending member is integral with the bottom shell.

23. The container of claim 1, wherein the bottom shell includes an upturned edge coupled to the outer periphery, the upturned edge having a radially inwardly opening channel configured to closely receive the bottom coil.

24. The container of claim 23, wherein the horizontally extending member is an upper surface of the inwardly opening channel.

25. The container of claim 23, further including a ramp formed on an inwardly facing surface of the upturned edge for guiding the bottom coil into the radially inwardly opening channel.

26. The container of claim 1, wherein the horizontally extending member is a plurality of horizontally extending members at radially spaced locations above the apex of the bottom coil.

27. The container of claim 1, wherein the horizontally extending member is single member extending above the apex of the bottom coil for substantially its entire distance around the bottom of the container.

28. The container of claim 27, wherein the horizontally extending member includes a gap configured for permitting the coil spring to extend upwardly from the bottom coil toward the top of the container.

29. A collapsible container having an expanded configuration and a collapsed configuration, comprising:

a sidewall formed of a flexible material, the sidewall having an upper end adjacent a top of the container and a lower end adjacent a bottom of the container;

a coil spring biasing the container to the expanded configuration, the coil spring having a top coil adjacent the top of the container and a bottom coil adjacent the bottom of the container;

a durable bottom layer affixed to the bottom of the container, the bottom layer including a substantially rigid plate central portion having an outer periphery underlying the bottom coil, and a substantially rigid horizontally extending member coupled to the bottom layer and overlying an apex of the bottom coil to vertically capture and clamp the bottom coil between the outer periphery of the bottom shell and the horizontally extending member.

30. The container of claim 29, wherein the durable bottom layer is a plastic shell having a thickness of between about 0.05 to 0.20 inches and the flexible sidewall material is a fabric layer having a thickness of between about 0.01 to 0.02 inches.

31. The container of claim 29, wherein the bottom layer includes an upturned edge coupled to the outer periphery, and the horizontally extending member extends radially inwardly from the upturned edge at one or more locations.

32. The container of claim 31, wherein the horizontally extending member is integral with the upturned edge.

33. The container of claim 29, wherein the horizontally extending member is integral with the bottom layer.

34. The container of claim 29, wherein the bottom layer includes an upturned edge coupled to the outer periphery, the upturned edge having a radially inwardly opening channel configured to closely receive the bottom coil.

35. The container of claim 34, wherein the horizontally extending member is an upper surface of the inwardly opening channel.

36. The container of claim 34, further including a ramp formed on an inwardly facing surface of the upturned edge for guiding the bottom coil into the radially inwardly opening channel.

37. The container of claim 29, wherein the horizontally extending member is a plurality of horizontally extending members at radially spaced locations above the apex of the bottom coil.

38. The container of claim 29, wherein the horizontally extending member is single member extending above the apex of the bottom coil for substantially its entire distance around the bottom of the container.

39. The container of claim 38, wherein the horizontally extending member includes a gap configured for permitting the coil spring to extend upwardly from the bottom coil toward the top of the container.

40. A collapsible container having an expanded configuration and a collapsed configuration, comprising:

a cylindrical sidewall formed of a flexible material, the sidewall having an upper end adjacent a top of the container and a lower end adjacent a bottom of the container, the sidewall being collapsible and expandable along an axis extending between the top and the bottom of the container;

a spring biasing the container to an expanded configuration, the spring including a lower end having a loop extending around a lower edge of the cylindrical sidewall material;

a durable plastic shell secured to the bottom of the container, the plastic shell including a plate-like central portion having an outer periphery underlying the loop, and a substantially rigid horizontally extending member coupled to the plastic shell and overlying an apex of the loop to vertically capture and clamp the bottom coil between the outer periphery of the plastic shell and the horizontally extending member.

41. The container of claim 40, wherein the flexible sidewall material is a fabric.

42. The container of claim 40, wherein the cylindrical sidewall is biased toward the expanded configuration by a coil spring.

43. The container of claim 40, wherein the durable plastic shell has a thickness of between about 0.05 to 0.20 inches and the flexible sidewall material has a thickness of between about 0.01 to 0.02 inches.

* * * * *